US007210191B2

(12) United States Patent
Bott et al.

(10) Patent No.: US 7,210,191 B2
(45) Date of Patent: May 1, 2007

(54) CABLE-PULL OPENING

(75) Inventors: Erich Bott, Hollstadt (DE); Wolfgang Kemmerzell, Gersfeld (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 538 days.

(21) Appl. No.: 10/739,250

(22) Filed: Dec. 18, 2003

(65) Prior Publication Data

US 2004/0181897 A1 Sep. 23, 2004

Related U.S. Application Data

(63) Continuation of application No. PCT/EP02/06600, filed on Jun. 14, 2002.

(30) Foreign Application Priority Data

Jun. 29, 2001 (DE) ..... 101 31 694

(51) Int. Cl.
*A47L 9/26* (2006.01)

(52) U.S. Cl. ..... 15/323; 15/327.2

(58) Field of Classification Search ..... 15/323, 15/327.2, 327.1; 191/12.4, 12.2 R; *A47L 9/26*
See application file for complete search history.

(56) References Cited

U.S. PATENT DOCUMENTS 3,447,189 A * 6/1969 Szabo ..... 15/323
3,999,640 A * 12/1976 Persson ..... 191/12.4
5,950,272 A * 9/1999 Kim et al. ..... 15/323
2002/0096411 A1* 7/2002 Tsuji et al. ..... 191/12 R

FOREIGN PATENT DOCUMENTS

GB 2324713 A * 11/1998

* cited by examiner

*Primary Examiner*—Theresa T. Snider
(74) *Attorney, Agent, or Firm*—Russell W. Wamock; Craig J. Loest

(57) ABSTRACT

A vacuum cleaner with a housing and a housing cover with a cable-pull opening in the housing cover. An electric cable has a plug on one end which can be pulled through a cut-out which is larger than the plug. During assembly the plug is pulled through the cut-out and then into a cable run area formed on one side of the cut-out and connected by a slit large enough for the cable but too small to accommodate the plug.

11 Claims, 2 Drawing Sheets

CABLE-PULL OPENING

BACKGROUND

The invention relates to a vacuum cleaner with a housing having a housing cover and a cable-pull opening arranged in the housing cover, from which cable-pull opening an electric cable having a plug on one end can be pulled out.

Such vacuum cleaners are already known.

The problem of the invention is to provide a vacuum cleaner that can be assembled with a housing having a housing cover and a cable-pull opening arranged in the housing cover, from which cable-pull opening an electric cable having a plug on one end can be pulled out.

SUMMARY

According to the invention, this problem is solved with a vacuum cleaner of the type mentioned in the outset by the fact that the cable-pull opening has a cut-out in the housing cover that is larger than a contour of the plug and that the cut-out is sealed by an element preventing the retraction of the plug into the interior of the vacuum cleaner.

As a result of the configuration of the cable-pull opening according to the invention, the plug is first pulled from inside through the opening in the housing cover during production of the vacuum cleaner and the opening is then sealed by an element to such an extent that the plug is not pulled into the interior of the vacuum cleaner, but the pulling-out or pulling-in of the cable respectively out of or into the vacuum cleaner is possible.

In this way, an easily producible vacuum cleaner is created, wherein a cable connected to a cable drum or another cable storage device and having a firmly connected plug at one end can easily be introduced into the vacuum cleaner. The putting together of the individual components of the vacuum cleaner is considerably facilitated.

Contour of the plug is understood to mean any projected area which, depending on the selected direction in space, must be free in order to pass the plug through the housing cover. Advantageous developments arise from the sub-claims.

In particular, the contour is the diameter of the plug at right angles to the direction of the contact pins, i.e. in the pulling direction of the cable, or a plane lying in the central axis of the plug.

To advantage, the element occupies an area surrounding the cable in a ring-like manner or, together with a housing wall, bordering the cable laterally. A closing part injected by means of a film hinge is particularly well suited for this. The housing cover area linked by means of the film hinge is folded over during production after the cable has been pulled in, so that the large opening is sealed, but the cable itself can still be pulled through the remaining open area.

A further advantageous development consists in the fact that the cable-pull opening has a slit at the side of the cable run area, said slit being connected with an opening which has a larger diameter than the plug and which is sealed by the element, whereby the cable run area and the slit have a clear width which prevents the through-passage of the plug.

It is particularly advantageous here for the slit to taper from the opening to the cable run area.

It is particularly advantageous for the slit to taper to a width that is smaller than the diameter of the cable and for the slit to be able to be elastically widened by the cable when the cable is pushed through from the side of the opening.

A vacuum cleaner wherein the slit has a wall pointing inwards is particularly well suited. The wall prevents the cable from being pulled out of the cable run area into the opening when it is reeled onto the cable drum.

A vacuum cleaner wherein the element is formed at least partially by display means or actuation means is advantageous.

A vacuum cleaner wherein the cable run area has a run-out slope can also be used to advantage.

The invention also relates to a method of producing a vacuum cleaner, according to which the plug and then the cable are pulled through the cable-pull opening from the inside outwards and the cable-pull opening is then reduced to a width which is such that it prevents a retraction of the plug into the interior of the vacuum cleaner.

DESCRIPTION OF THE DRAWINGS

The invention is explained below in greater detail in an example of embodiment with the aid of the drawings. They show.

DETAILED DESCRIPTION

Figure 1:
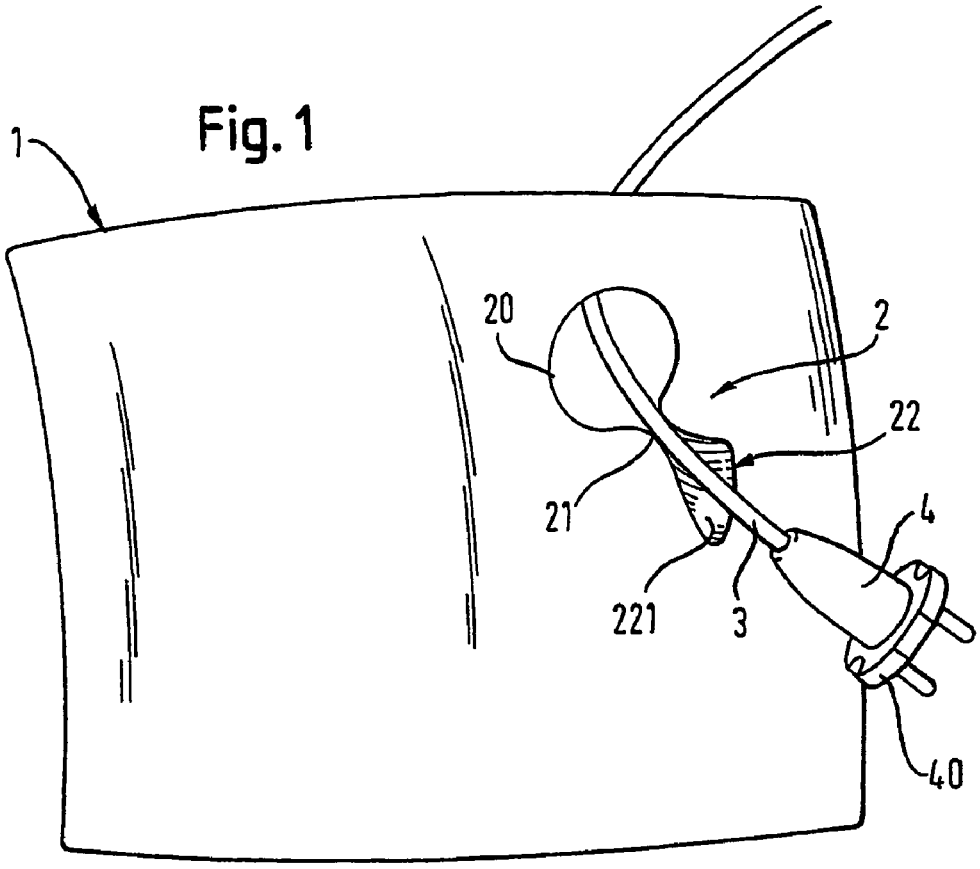
FIGS. 1 and 2 a housing cover through which a cable is passed.

A housing cover 1 for a vacuum cleaner has an essentially convex shape and has a cable-pull opening 2 in order to pull an electric cable 3 together with a plug 4 attached to the end of cable 3 from the interior of the vacuum cleaner, i.e. from the area accommodating the cable drum, to the exterior.

Cable-pull opening 2 has an opening 20, a slit 21 and a cable run area 22. Cable 3 together with plug 4 is first pulled out of the interior area of the vacuum cleaner through opening 20 during production. For this purpose, opening 20 has a side edge which enables a smooth threading-in or pulling-in of plug 4. When plug 4 is to be pulled through in the longitudinal direction of cable 3, the opening has a contour enclosing the diameter of a plastic annular body 40 of plug 4.

After plug 4 has been pulled through opening 20, cable 3 is pulled through slit 21 in cable run area 22, through which slit only cable 3 may pass inside, in order that cable 3 is always pulled out from the vacuum cleaner solely from cable run area 22 when the vacuum cleaner is being used by a user in the due manner and, after completion of vacuum cleaning, is then conveyed back into the vacuum cleaner solely in the cable run area, without plug 4 being able to be pulled into the interior of the vacuum cleaner.

For better handling of cable 3, cable run area 22 has a run-out slope 221, on which plug 4 lies in the pulled-in state of cable 3, so that said plug can easily be gripped by the user.

Figure 2:
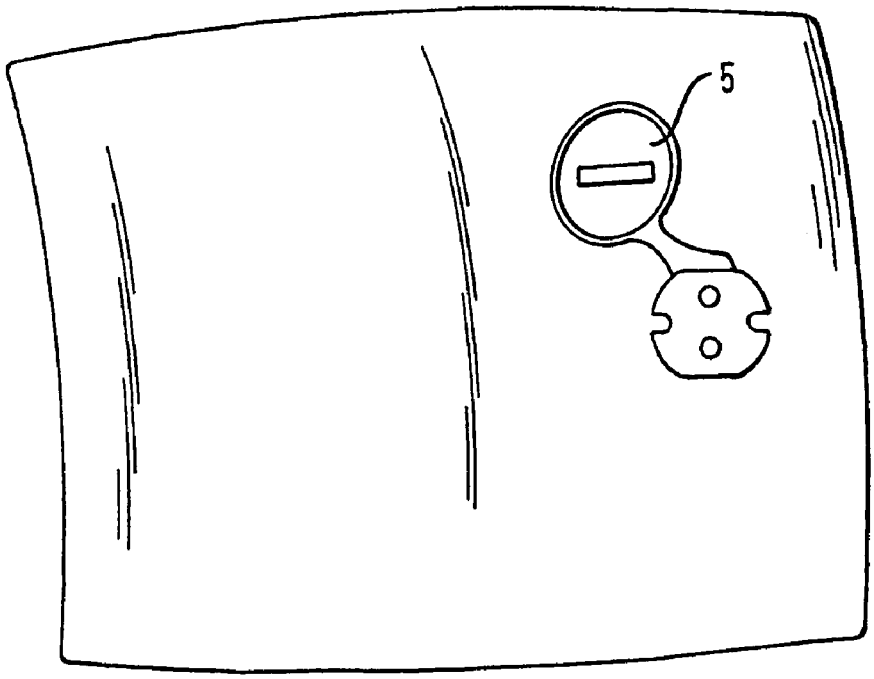

Opening 20 accommodates a display element, which displays a certain state of the vacuum cleaner, such as for example the extent to which the vacuum bag is full, or an operating element 5 (FIG. 2), for example the on/off switch, which can also be used for the power adjustment.

Figure 3:
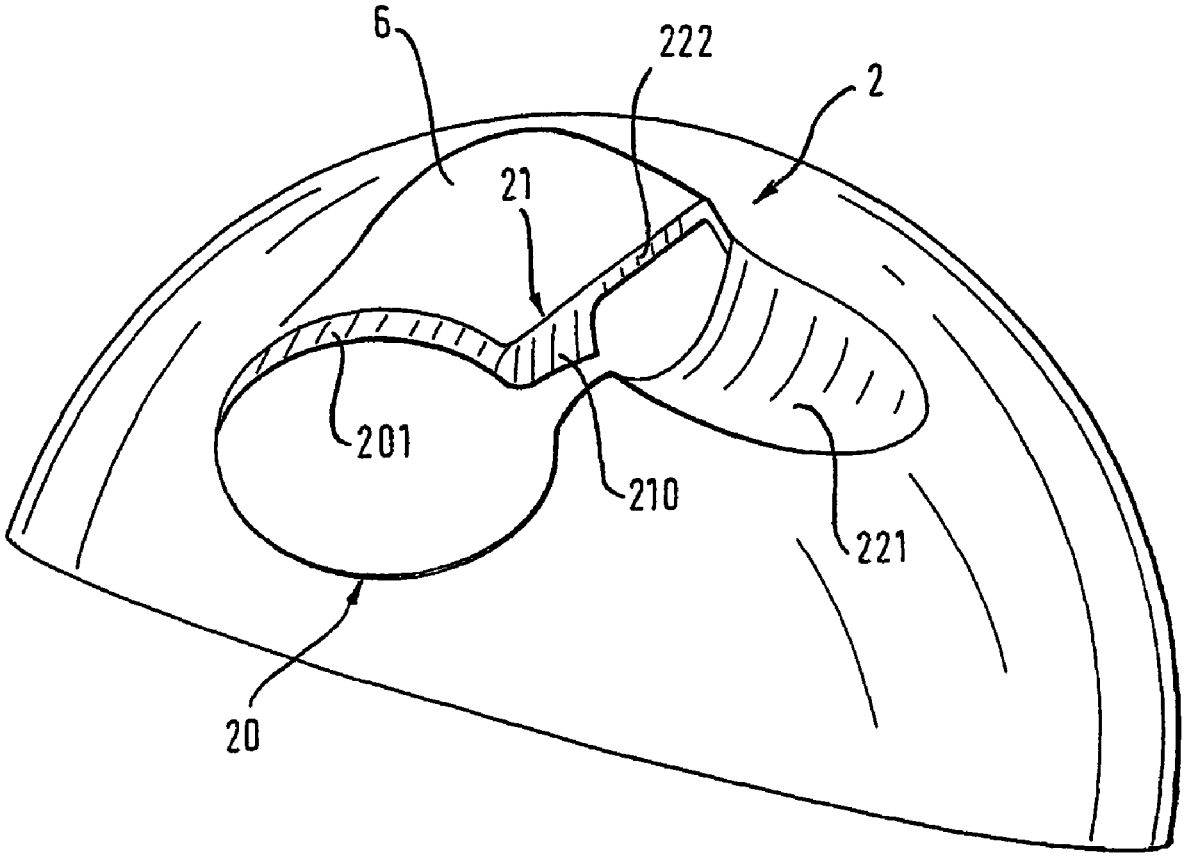
FIG. 3 the housing cover with a wall pointing inwards.

In order to prevent cable 4 from being pulled out of cable run area 22, slit 21 is provided with a wall 210 forming a lip (FIG. 3). Wall 210 preferably merges into a wall 222 of cable run area 22 and a wall 201 of opening 20. Wall 201 is used for the lateral fixing of operating element 5. Wall 222 is used for better guidance of cable 4.

Area 6 (FIG. 3) projects beyond the convex area of housing cover 1 and is designed more convex than the latter. Area 6 also serves to facilitate the pulling-out and pulling-in of cable 4.

The invention provides a vacuum cleaner with a housing cover 1, wherein a plug 4 on a cable 3 is pulled from the inside through a large opening 20 during assembly, whereby during the assembly process cable 3 is pulled through a narrow slit 21 into a cable run area 22 after plug 4 has been pulled through. Cable run area 22 is formed in such a way that plug 4 knocks against housing cover 1. During assembly of housing cover 1, opening 20 is sealed on a lower part of the vacuum cleaner by a component which is already mounted in said lower part, such as operating element 5. This component thereby performs the additional function of sealing housing cover 1. This construction dispenses with the need to use a separate closing part for opening 20 once cable 3 and plug 4 have been assembled.

Instead of the closing part, a closing part rigidly injected by means of a film hinge can also be used as an alternative. This closing part is folded over after the plug has been pulled through; opening 20 is thus sealed.

The invention claimed is:

1. A vacuum cleaner with a housing having a housing cover and a cable-pull opening formed in the housing, from which cable-pull opening an electrical cable having a plug on one end can be pulled out, the cable-pull opening having a cut-out in the housing cover that is larger than a contour of the plug, the vacuum cleaner comprising:

a cable run area at one side of the cut-out thereof; and a slit connecting said cable run area to said cut-out, said slit having a width that prevents said plug contour from passing therethrough and back into said housing.

2. The vacuum cleaner according to claim 1, wherein said cut-out is sealed by an element preventing the retraction of said plug contour into the interior of the vacuum cleaner.

3. The vacuum cleaner according to claim 2, wherein said element surrounds said cable in a ring-like manner.

4. The vacuum cleaner according to claim 3, wherein said element is a closing part formed by a film hinge.

5. The vacuum cleaner according to claim 4, wherein said slit tapers from said cut-out opening to said cable run area.

6. The vacuum cleaner according to claim 5, wherein said slit tapers to a width smaller than the diameter of said cable and said slit can be elastically widened by said cable when said cable is pushed through from the side of said cut-out opening.

7. The vacuum cleaner according to claim 6, wherein said slit has a wall pointing inwards.

8. The vacuum cleaner according to claim 2, wherein said element is formed at least partially by an operating element of the vacuum cleaner.

9. The vacuum cleaner according to claim 8, wherein said operating element of the vacuum cleaner is one of a display element or actuation element.

10. The vacuum cleaner according to claim 1, wherein said cable run area includes a run-out slope.

11. The vacuum cleaner according to claim 2, wherein said element laterally borders said cable with a housing wall of said opening.

* * * * *